US007384309B1

(12) United States Patent
Morello et al.

(10) Patent No.: US 7,384,309 B1
(45) Date of Patent: Jun. 10, 2008

(54) ELECTRICAL CONNECTOR BODY HAVING CANTILEVERED TERMINAL HOLD-DOWN BEAMS

(75) Inventors: John R. Morello, Warren, OH (US); James M. Rainey, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/654,823

(22) Filed: Jan. 18, 2007

(51) Int. Cl.
*H01R 13/40* (2006.01)

(52) U.S. Cl. ..... 439/595; 29/858

(58) Field of Classification Search ..... 439/595, 439/744, 871, 752; 29/858, 883, 856
See application file for complete search history.

(56) References Cited

U.S. PATENT DOCUMENTS 5,980,318 A 11/1999 Morello et al.
5,989,066 A * 11/1999 Cox ..... 439/595
6,354,873 B1 3/2002 Morello et al.
6,733,306 B2 * 5/2004 Kane et al. ..... 439/79
7,048,584 B1 5/2006 Morello et al.

* cited by examiner

*Primary Examiner*—Ross N Gushi
(74) *Attorney, Agent, or Firm*—David P. Wood

(57) ABSTRACT

An electrical connector body includes a rear face, a front face, and a terminal cavity longitudinally extending substantially between the rear and front faces. A rigid retention wall longitudinally extends at least partially between the rear and front faces and includes a terminal retention feature. At least two cantilevered hold-down beams are substantially opposed from the rigid retention wall.

12 Claims, 2 Drawing Sheets

ELECTRICAL CONNECTOR BODY HAVING CANTILEVERED TERMINAL HOLD-DOWN BEAMS

FIELD OF THE INVENTION

This invention relates generally to electrical connectors and more particularly to electrical connectors including terminal hold-down elements.

BACKGROUND OF THE INVENTION

An electrical connector typically includes a conductive terminal for terminating a wire or other electrical element, and a non-conductive connector body for carrying the terminal. The connector body usually includes laterally opposed sidewalls and vertically opposed transversely extending walls between the sidewalls. The sidewalls and transversely extending walls generally define a terminal cavity for receiving the terminal. One of the transverse walls is a rigid retention wall including a lock nib projecting into the terminal cavity, and the terminal includes a lock edge that engages the lock nib to retain the terminal in the terminal cavity. The other of the transverse walls is a flexible hold-down beam having a protuberance projecting into the terminal cavity and contacting the terminal to bias the terminal into engagement with the lock nib.

Although this connector works very well in many applications, the flexural performance requirements of the flexible hold-down beam are not optimally suited for certain low strain materials. For example, connector bodies are increasingly molded from glass-filled polymers, which enable higher axial terminal retention performance but exhibit lower strain and flexural performance. Accordingly, small glass-filled connector bodies are not well suited for use with the conventional flexible hold-down beam. In fact, to accommodate use of glass-filled polymers for small connector applications, prior art designs require a two-piece connector. The typical two-piece connector includes a body and an intermediate engagement member carried by the body. The intermediate engagement member may be a terminal position assurance (TPA) device, a primary lock reinforcement (PLR), or the like. But such designs can increase complexity and cost of small connectors.

SUMMARY OF THE INVENTION

This invention provides an electrical connector body including a rear face, a front face, and a terminal cavity longitudinally extending substantially between the rear and front faces. Also, the connector body includes a rigid retention wall longitudinally extending at least partially between the rear and front faces and including a terminal retention feature. Finally, the body further includes at least two cantilevered hold-down beams substantially opposed from the rigid retention wall and, preferably, providing a combined terminal hold-down force and enabling the body to be composed of a glass-filled material.

DETAILED DESCRIPTION OF THE PREFERRED EMBODIMENTS

Figure 1:
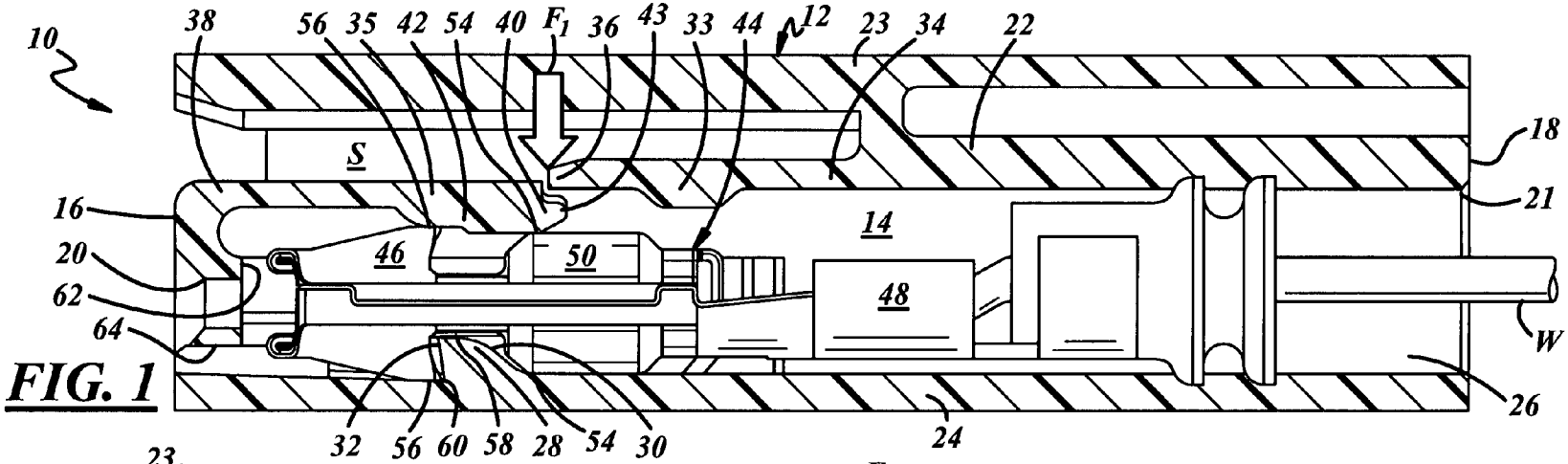
FIG. 1 is a partial cross-sectional view of a connector including an electrical terminal disposed in a connector body, according to an exemplary embodiment of the present invention.
Figure 2:
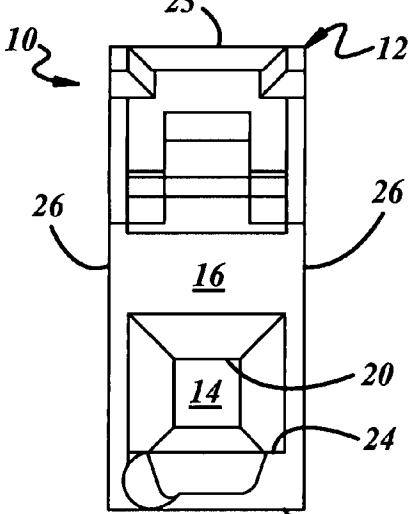
FIG. 2 is an end view of the connector of FIG. 1.

Referring to FIGS. 1 and 2, an electrical connector 10 according to an exemplary embodiment of the present invention includes a connector body 12 having one or more terminal cavities 14 formed therein. The connector body 12 includes a front face 16 and a rear face 18. The front face 16 has one or more front openings 20 and the rear face 18 has one or more rear openings 21, each corresponding with respective terminal cavities 14, which extend front to rear in a longitudinal direction.

The illustrated terminal cavity 14 is defined in part by rigid walls 22, 23, 24 and opposed sidewalls 26, and extends substantially between the front and rear faces 16, 18. The rigid walls 22, 23, 24 are attached along their edges to other portions of the connector body 12. More specifically, the walls 22, 23, 24 are attached along at least portions of at least two of their edges and preferably along all four of their edges to prevent movement or flexing of the rigid walls 22, 23, 24. For example, the rigid walls 22, 23, 24 can be end walls or partition walls of the connector body 12. It is also contemplated that one or more of the walls 22, 23, 24, could be attached along less than all four of their edges, such that the walls 22, 23, 24 are beams or the like. It is further contemplated that wall 23 and wall 24 could be integrated into a single combined wall.

In any case, the rigid walls 22, 23, 24 can longitudinally extend at least partially between the front and rear faces 16, 18. For example, the rigid wall 22 extends forward from the rear face 18 and is connected by a bridge portion to another rigid wall 23. In contrast, the other rigid wall 24 extends forward from the rear face 18 to the front face 16 and is preferably a rigid retention wall 24 carrying a rigid, terminal retention feature 28 that extends into the terminal cavity 14. The retention feature 28 can be a rigid lock nib that includes a sloped surface 30 that starts nearest the rear face 18 of the connector body and terminates at a lock shoulder 32 on the retention feature 28 formed nearest the front face 16.

Cantilevered hold-down beams 33, 35 are disposed substantially opposite with respect to the rigid retention wall 24. Preferably, the hold-down beams 33, 35 are two in number, generally opposed to one another, flexible, and attached at their fixed ends 34, 38 to other portions of the connector body 12. As will be described below, whereas the rigid retention wall 24 carries longitudinal retention forces, the hold-down beams 33, 35 preferably act in concert as a hold-down spring. A space S is provided between another rigid wall 23 and the hold-down beams 33, 35 to facilitate movement or deflection of the hold-down beams 33, 35.

The hold-down beams 33, 35 include a first hold-down beam 33, and a second hold-down beam 35. The first hold-down beam 33 is preferably attached at a fixed end 34 to one of the rigid walls 22, and is cantilevered therefrom in a forward longitudinal direction to terminate in a free end 36. The second hold-down beam 35 is preferably attached at a fixed end 38 to the front face 16 and is cantilevered therefrom in a rearward longitudinal direction to terminate in a free end 40. A terminal hold-down projection 42 may be provided on the second hold-down beam 35 and extends toward the rigid retention wall 24 at a location generally opposite the retention feature 28. The projection 42 may be stepped, and may also include an axially rearward projection 43 to engage the first hold-down beam 33.

The connector body 12 is constructed and arranged for receiving an electrical terminal 44 in each of the terminal cavities 14. The connector body 12 is preferably composed of any suitable electrically non-conductive material, whereas the electrical terminal 44 is composed of any suitable electrically conductive material. The electrical terminal 44 may be any suitable type of terminal and, as shown, can be a female terminal. The terminal 44 may include a contact portion 46 and a crimp portion 48, and an intermediate body portion 50. The contact portion 46 can be open, for example to receive a male terminal, and the crimp portion 48 is constructed for attachment to a wire W. The terminal 44 has a first surface 54 for contact with a portion of the second hold-down beam 35, and a second surface 56 also for contact with another portion of the second hold-down beam 35. Also, the terminal 44 has a relief 58, such as a recess or an aperture, for receiving the retention feature 28, and a rigid lock edge 60 associated with the relief 58 for engaging the lock shoulder 32 of the retention feature 28.

Figure 3:
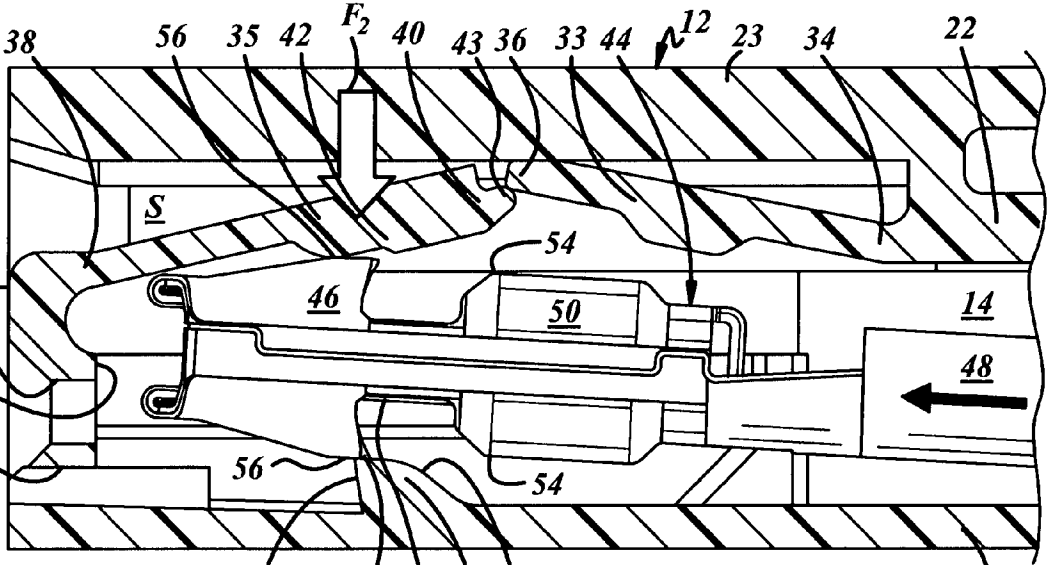
FIG. 3 is a partial cross-sectional view of the connector of FIG. 1, illustrating insertion of the electrical terminal into the connector body.

To assemble the connector 10, the contact portion 46 of the terminal 44 is inserted through the rear opening 21 in the rear face 18 and into the terminal cavity 14. As best shown in FIG. 3, an angled surface of the contact portion 46 of the terminal 44 engages the retention feature 28 and the terminal 44 rides up the sloped surface 30 thereof to lift the terminal 44 generally away from the rigid retention wall 24 and toward the hold-down beams 33, 35. As the terminal 44 rides up the sloped surface 30 of the retention feature 28, the second surface 56 of the terminal 44 engages the stepped projection 42 and the second hold-down beam 35 flexes. The second hold-down beam 35 flexes such that the rearward projection 43 thereof engages the first hold-down beam 33, which also flexes. Accordingly, there is a sliding and lifting action between the rearward projection 43 and a corresponding portion of the first hold-down beam 33.

The hold-down beams 33, 35 are resilient such that they tend to recover their rest position under their own inherent resilient bias force. Thus, the second hold-down beam 35 flexes during terminal engagement and then engages the first hold-down beam 33. The inherent resilient bias forces of the hold-down beams 33, 35 result in a combined hold-down force $F_2$. Both beams 33, 35 flex into the space S to accommodate the movement of the terminal 44 over the retention feature 28. The terminal 44 is pushed forward until the rigid lock edge 60 snaps in front of the retention feature 28 at which point the terminal 44 is forced against the rigid retention wall 24 by the combined resilient force $F_2$ of the hold-down beams 33, 35 such that the recess or aperture 58 overlies the retention feature 28.

Referring to FIG. 1, one or both of the hold-down beams 33, 35 apply a sufficient hold-down force $F_1$ to hold the terminal 44 in engagement with the retention feature 28 of the rigid retention wall 24 and to maintain the rigid lock edge 60 against the lock shoulder 32 of the retention feature 28, thereby preventing inadvertent dislocation and rearward withdrawal of the terminal 44 from the cavity 14. In this position, the stepped projection 42 rests against the front end 46 and the body 50 of the terminal 44. Also, the free end 36 of the first hold-down beam 33 can rest against the free end 40 of the second hold-down beam 35 or, as shown, there can be a slight clearance therebetween. In either case, if the terminal 44 moves away from the rigid retention wall 24 and toward the other rigid walls 22, 23 the hold-down force $F_2$ of the one or both of the hold-down beams 33, 35 tends to keep the terminal 44 seated and engaged in the terminal cavity 14.

The dual beams 33, 35 enable the connector body 12 to be composed of any suitable glass-filled material. For example, connector bodies for small terminals, for example about 0.64 to 1.2 mm, can be composed of glass-filled material to achieve desired terminal retention specifications. The connector body 12 can be composed of any suitable glass-filled material such as a glass-filled polyester, such as glass-filled polybutylene terephthalate (PBT). The material may include any suitable amount of glass material and, for example, may be a 20% glass-filled PBT material. Because the dual cantilevered hold-down beams 33, 35 each undergo less strain than would a single simple beam, the present invention enables lower strain levels than conventional connector bodies with a single simple flexible hold-down beam. In other words, the hold-down beams 33, 35 impose at least as much force on the terminal 44 as a conventional single simple beam, but with considerably less strain thereon. Accordingly, the terminal 44 can be inserted and removed from the connector body 12 without fracturing the hold-down beams 33, 35.

A stop 62, such as an inside surface of the front face 16, can be provided in the connector body 12 to prevent the terminal 44 from moving too far in a forward direction. A male terminal blade (not shown) may be inserted through the opening 20 in the front face 16 of the connector body 12 and into the open end 46 of the female terminal 44. Another opening 64 may be provided in the front face 16 of the connector body 12 so that a tool (not shown) may be inserted therethrough to lift the electrical terminal 44 so that the lock edge 60 can clear the retention feature 28 to allow the female terminal 44 to be removed through the rear opening 21 in the rear face 18.

Figure 4:
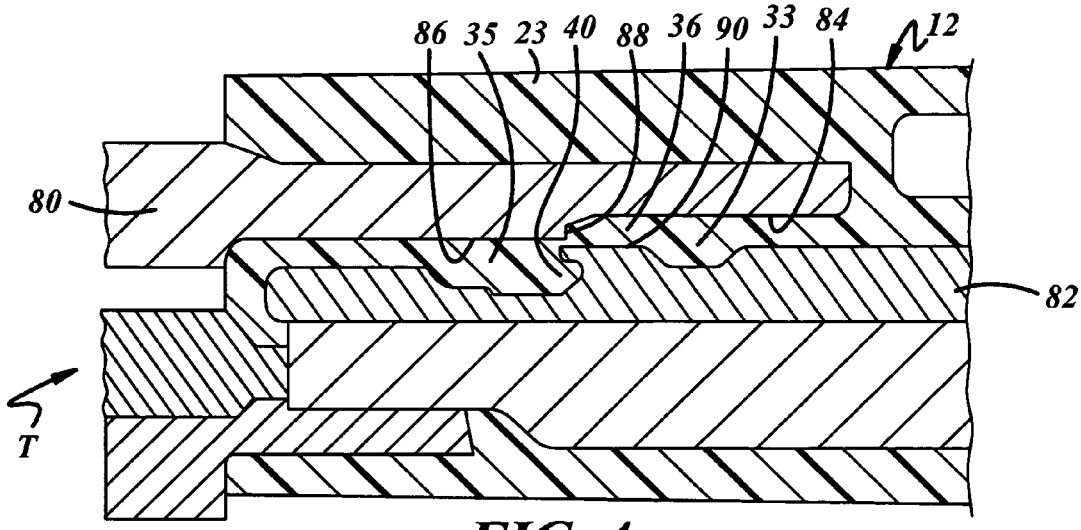
FIG. 4 is a partial cross-sectional view of the connector body of FIG. 1, as molded using mold tooling.
Figure 5:
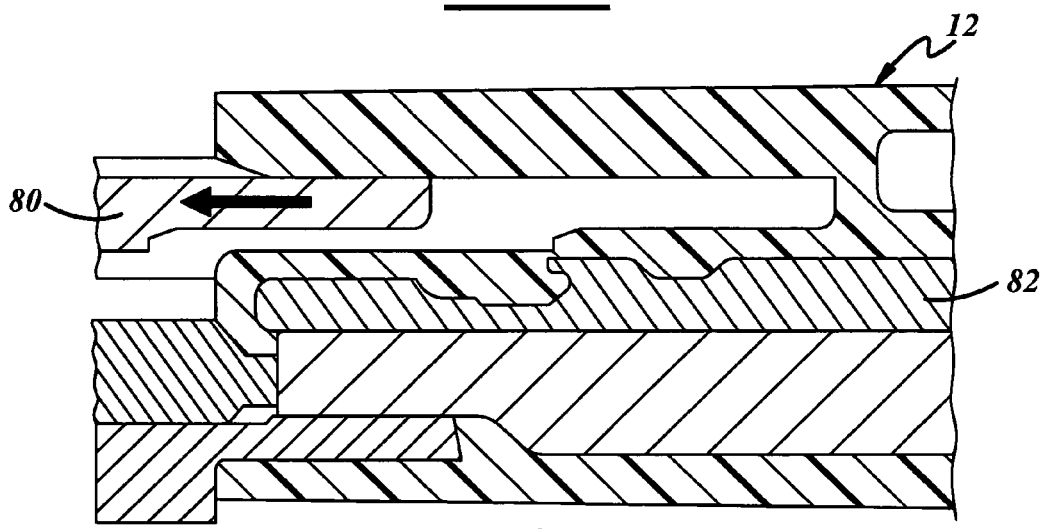
FIG. 5 is a partial cross-sectional view illustrating initial retraction of the mold tooling from the connector body of FIG. 4.
Figure 6:
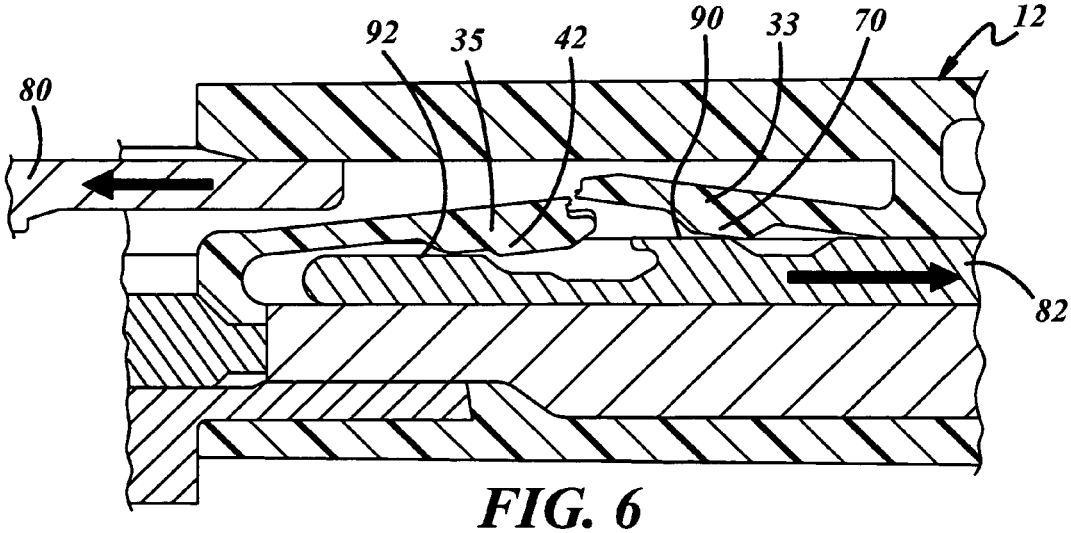
FIG. 6 is a partial cross-sectional view illustrating continued retraction of the mold tooling from the connector body of FIG. 5.

Referring now to FIGS. 4 through 6, a portion of the connector body 12 is shown as molded, using mold tooling T shown in its mold fill position. The mold tooling T is designed and its movement timed to eliminate a die lock condition, and the connector body 12 is designed to allow the hold-down beams 33, 35 to deflect during retraction of the mold tooling T.

As shown in FIG. 4, the mold tooling T includes a forward core 80 between the hold-down beams 33, 35 and the rigid wall 23, and a rearward core 82 between the hold-down beams 33, 35 and the rigid retention wall 24. The forward core 80 includes a first surface 84 partially defining a portion of the first hold-down beam 33, a second surface 86 partially defining a portion the second hold-down beam 35, and a step 88 therebetween. The rearward core 82 includes a projection 90 that partially defines a portion of the free end 36 of the first hold-down beam 33, and a portion of the free end 40 of the second hold-down beam 35. The step 88 of the forward core 80 and the projection 90 of the rearward core 82 may be slightly spaced apart to allow connector material to fill and possibly temporarily connect the free ends 36, 40 of the hold-down beams 33, 35 to one another. The connector body 12 is molded with the forward and rearward cores 80, 82 in their mold-fill positions.

As shown in FIG. 5, extraction of the forward core 80 is initiated before extraction of the rearward core 82 is initiated. Accordingly, the forward core 80 is shown being moved from its mold fill position, while the rearward core 82 is shown stationary in its mold fill position.

As shown in FIG. 6, the forward core 80 is shown moved even further away from its mold fill position, while the rearward core 82 is shown in an initial extraction stage, being moved from its mold fill position. In other words, retraction of the forward core 80 is initiated and, then, after a predetermined delay, retraction of the rearward core 82 is initiated. As the rearward core 82 is extracted, the hold-down beams 33, 35 deflect into the space S between the beams 33, 35 and wall 23 to allow the rearward core 82 to move relative thereto, thereby avoiding a die lock condition. The hold-down beams 33, 35 deflect as the projection 90 of the rearward core 82 engages a projection 70 of the first hold-down beam 33 and a forward portion 92 of the rearward core 82 engages the stepped projection 42 of the second hold-down beam 35. As the hold-down beams 33, 35 deflect, any interconnection therebetween fractures, thereby freeing the hold-down beams 33, 35 from one another and allowing the hold-down beams 33, 35 to function as cantilevered beams. The projection 70 of the first hold-down beam may be provided to guide the terminal 44 under the second hold-down beam 35 such that the terminal 44 does not catch or hang up on the second hold-down beam 35.

The electrical connector body according to the present invention has a relatively low profile, is simple in design, easy to manufacture, provides a sufficient hold-down force on an electrical terminal, yet can be composed of any suitable glass-filled material, all of which heretofore has been absent in prior art designs.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connector body comprising:

a rear face;

a front face;

a terminal cavity longitudinally extending substantially between the rear and front faces;

a rigid retention wall longitudinally extending at least partially between the rear and front faces and including a rigid terminal retention feature that extends into the cavity; and at least two cantilevered flexible hold-down beams substantially opposed from the rigid retention wall.

2. The electrical connector body of claim 1, wherein the at least two flexible cantilevered hold-down beams include a first flexible hold-down beam cantilevered in a forward direction, and a second flexible hold-down beam cantilevered in a rearward direction and wherein the first flexible hold-down beam and the second flexible hold-down beam are an integral part of the electrical connector body.

3. The electrical connector body of claim 2, wherein the second flexible hold-down beam is cantilevered from the front face, the second terminal hold beam being sufficiently flexible to allow the terminal to ride over the rigid retention feature that extends in to the cavity when the terminal is inserted into the cavity.

4. The electrical connector body of claim 2, wherein the first flexible hold-down beam includes a projection.

5. The electrical connector body of claim 1, wherein the body is composed of a glass-filled polymer.

6. The electrical connector body of claim 5, wherein the glass-filled polymer is a glass-filled polyester.

7. The electrical connector body of claim 6, wherein the glass-filled polyester is glass-filled PBT.

8. The electrical connector body of claim 7, wherein the glass-filled polyester is a 20% glass-filled PBT.

9. An electrical connector body comprising:

a rear face;

a front face;

a terminal cavity longitudinally extending substantially between the rear and front faces;

a rigid retention wall longitudinally extending at least partially between the rear and front faces and including a terminal retention feature; and at least two cantilevered hold-down beams substantially opposed from the rigid retention wall, wherein the at least two cantilevered hold-down beams include a first hold-down beam cantilevered in a forward direction, and a second hold-down beam cantilevered in a rearward direction, and wherein the second hold-down beam includes a terminal hold-down projection extending into the terminal cavity at a location generally opposite the terminal retention feature of the rigid retention wall.

10. The electrical connector body of claim 9, wherein the terminal hold-down projection is stepped and includes a rearward projection to engage the first hold-down beam.

11. An electrical connector, comprising:

an electrical terminal including a lock edge; and a connector body carrying the electrical terminal and comprising:

a rear face including a rear opening;

a front face including a front opening;

sidewalls longitudinally extending between the front and rear faces;

rigid walls transversely extending between the sidewalls and longitudinally extending at least partially between the front and rear faces, and including at least one terminal rigid retention feature for engagement with the lock edge of the electrical terminal;

a terminal cavity carrying the electrical terminal therein, wherein the terminal cavity longitudinally extends substantially between the front and rear faces and is at least partially defined by the sidewalls and the rigid walls;

the rigid retention feature extending into the cavity for engagement with the lock edge of the electrical terminal; and dual, opposed, flexible cantilevered hold-down beams substantially opposed from the at least one terminal retention feature of the rigid walls to provide a combined terminal hold-down force and enable the connector body to be composed of a glass-filled material, and including:

a first flexible hold-down beam cantilevered from one of the rigid walls; and a second flexible hold-down beam cantilevered from the front face.

12. A method of manufacturing an electrical connector body including a rigid wall including at least one terminal retention feature, and dual cantilevered hold-down beams substantially opposed from the rigid wall and including a first hold-down beam having a projection and a second hold-down beam also having a projection, wherein the method comprises:

providing a forward core including first and second surfaces adapted to at least partially define portions of the first and second hold-down beams;

providing a rearward core including a forward portion adapted to at least partially define a portion of the second hold-down beam, and further including a projection disposed rearward of the forward portion and adapted to at least partially define a portion of the second hold-down beam and a portion of the first hold-down beam, wherein the second hold-down beam projection is at least partially defined between the forward portion and the rearward core projection;

molding the connector body with the forward and rearward cores in their mold-fill positions;

initiating retraction of the forward core from its mold-fill position to leave a space defined between the cantilevered hold-down beams and one of the rigid walls; and then, after a delay, initiating retraction of the rearward core from its mold-fill position wherein the rearward core projection engages the first hold-down beam projection and the forward portion of the rearward core engages the second hold-down beam projection so as to deflect the hold-down beams to allow the rearward core to be retracted without a die lock condition.

* * * * *